United States Patent [19]

Skyttä

[11] Patent Number: 4,735,686

[45] Date of Patent: Apr. 5, 1988

[54] TWIN-WIRE FORMER AND METHOD FOR FORMING A PAPER WEB WITH STEAM IMPLOSION

[75] Inventor: Osme Skyttä, Jyväskylä, Finland

[73] Assignee: Valmet Oy, Finland

[21] Appl. No.: 870,037

[22] Filed: Jun. 3, 1986

[30] Foreign Application Priority Data

Jun. 7, 1985 [FI] Finland ..... 852291

[51] Int. Cl.[4] ..... D21F 1/00; D21F 1/60

[52] U.S. Cl. ..... 162/203; 162/207; 162/209; 162/211; 162/300; 162/301; 162/351; 162/357

[58] Field of Search ..... 162/297, 300, 301, 203, 162/207, 208, 209, 210, 211, 357, 351, 352, 354, 355, 308

[56] References Cited

U.S. PATENT DOCUMENTS

| | | | |
|---|---|---|---|
| 1,739,038 | 12/1929 | Millspaugh | 162/297 |
| 3,839,143 | 10/1974 | Suckow | 162/301 |
| 3,846,233 | 11/1974 | Kankaanpaa | 162/301 |
| 3,981,768 | 9/1976 | Lehtinen | 162/199 |
| 3,996,098 | 12/1976 | Kankaanpaa | 162/301 |
| 4,306,934 | 12/1981 | Seppanen | 162/209 |
| 4,363,701 | 12/1982 | Kawae et al. | 162/301 |

FOREIGN PATENT DOCUMENTS

| | | | |
|---|---|---|---|
| 246048 | 1/1925 | United Kingdom | 162/203 |

*Primary Examiner*—S. Leon Bashore
*Assistant Examiner*—K. M. Hastings
*Attorney, Agent, or Firm*—Steinberg & Raskin

[57] ABSTRACT

A method for forming a paper web by which web formation is improved and flocculation in the web is reduced includes the steps of feeding steam under pressure into the fiber suspension when the suspension enters into the gap of the former and as web formation is initiated over the perforated mantle of the forming roll. The steam is fed from a steam supply chamber or the like provided within the forming roll through the perforations in the roll mantle within a steam supply sector of the roll mantle. The steam feed is applied to the pulp web when the web is still substantially uncouched and in a manner such that when the steam condenses in the pulp suspension, an implosion is generated in the pulp suspension which produces high frequency mechanical vibrations which can be closely controlled to achieve the desired effects. A twin-wire former and forming roll therefor for applying the method are also disclosed.

10 Claims, 2 Drawing Sheets

TWIN-WIRE FORMER AND METHOD FOR FORMING A PAPER WEB WITH STEAM IMPLOSION

BACKGROUND OF THE INVENTION

The invention relates to a method for forming a paper web by which web formation is improved and flocculation is reduced.

The invention further relates to a twin-wire former of a paper machine including a carrying wire and a covering wire whose loops are guided by forming rolls and guide rolls to form a twin-wire forming zone at the region of the forming rolls, the forming zone beginning at the forming gap defined by the wires and into which gap a pulp suspension jet is fed from the slice of a head box.

The invention also relates to a forming roll for a paper machine which includes a perforated mantle within the interior of which a chamber system is arranged which includes at least one negative-pressure chamber which communicates with at least one negative-pressure zone defined by sealing members which act against the inner surface of the roll mantle.

In old single-wire forming machines, vibrating forming boards were used in order to improve the formation of the web being formed. Although this technique has proved useful in connection with single-wire machines, it is not suitable for use in modern high-speed paper machines and, in particular, in twin-wire formers. One technique used to improve web formation is by appropriately shaping the suspension ducts of the head box, discussed below.

As is known, attempts have been made to improve formation of the paper web in twin-wire formers by providing various combinations of forming members, such as forming rolls and stationary forming shoes, and by selecting the dewatering directions of the web so that by means of, for example, lath shoes of the stationary forming shoes, a pulsating dewatering pressure is produced in the pulp layer being formed. The pulsating dewatering pressure affects the homogeniety of the fiber structure in the web to reduce its flocculation. However, it is frequently not possible by these methods to alter the non-homogeniety of the pulp suspension in the jet being discharged from the head box slice sufficiently efficiently. Improvement in web formation obtained by shaping the suspension ducts in the head box is also reaching a limit as illustrated by the following example. The output of the feed pump for the head box is typically 1.2 MW. Nevertheless, the microturbulence output of the head box, produced by means of the turbulence generator of the head box, is only on the order of about 20 kW. The microturbulence output of the pulp suspension flow immediately after the turbulence generator is on the order of about 1.2 kW and the output remaining at the discharged jet is only about 5 W.

The homogeneity of the formed paper web has become even more important in recent years with the introduction of thinner printing paper qualities and with the advent of complicated high speed printing machines. On the other hand, the homogeneity of the paper web which is produced also affects the running quality of the paper machine in that it is usually the weakest portions of the web, i.e., the non-homogeneous portions thereof, that cause breaks in the paper web and consequent down time of the machine.

It is also known to use steam implosion in the former of a paper machine to improve the formation of the web and to reduce web flocculation. In this respect, reference is made to U.S. Pat. No. 3,981,768, assigned to applicant's assignee, as well as to U.S. Pat. Nos. 3,970,513 and 3,992,254.

SUMMARY OF THE INVENTION

It is a general object of the present invention to improve the methods and apparatus disclosed in U.S. Pat. No. 3,981,768 and to broaden the applicability of the steam implosion techniques of the type described therein.

Another object of the present invention is to provide new and improved twin-wire formers and methods for forming a paper web.

Still another object of the present invention is to provide new and improved forming rolls for use in twin-wire formers for forming a paper web.

A further object of the present invention is to provide new and improved twin-wire formers and methods for forming a paper web and a forming roll for use in the former which are advantageous in view of the paper manufacturing process and in view of energy economy and which improve the web formation to a significant extent.

Briefly, in accordance with the method of the invention, these and other objects are attained by providing a method including the steps of feeding pressurized steam into the fiber suspension as the suspension enters into the gap of the former and as the web begins to form over the perforated mantle of the forming roll, feeding the steam from a steam supply chamber or the like provided within the forming roll through perforations in the roll mantle within a certain steam supply sector of the roll mantle, the steam feed being applied to the pulp web when the web is still substantially uncouched, and arranging the steam feed to take place in a manner such that when the steam condenses in the pulp suspension, an implosion is generated therein which produces high frequency mechanical vibrations which can be closely controlled in order to achieve the desired results.

In accordance with the web former of the invention, a twin-wire former comprises a carrying wire and a covering wire which define a forming gap in the region of a forming roll. The forming roll is provided with a perforated mantle over which one of the wires runs within the region of the forming gap. A steam supply chamber is provided within the forming roll and has a steam supply sector which communicates with the pulp suspension layer through the wire which runs over the perforated mantle while the pulp suspension layer is still substantially uncouched.

In accordance with the forming roll of the invention, a forming roll includes a perforated mantle in the interior of which at least one negative-pressure chamber is provided. Before the negative-pressure chamber, in the direction of rotation of the roll, a steam supply chamber is located which is provided with sealing members which act against the mantle to confine the leakage in the roll to only the steam supply sector. The geometry and pattern of the perforations in the roll mantle are selected so as to be suitable in view of the vibration effect applied by the steam feed which takes place through the steam supply chamber to the pulp web that is being formed.

In the former and method of the invention, the waste steam produced at a paper mill, e.g. the fibrous waste steam produced in connection with the production of thermomechanical pulp (TMP) of a newsprint mill, is advantageously utilized as the steam supply for the steam feed. The steam used in accordance with the invention is preferably only slightly pressurized. For example, the steam pressure in the steam supply box of the forming roll in accordance with the invention may be in the range of between about 1.01 to 1.05 bars.

It is seen from the foregoing that in accordance with the present invention, the formation of the paper web is improved immediately at the initial stage of the web formation process, or immediately prior to the initiation of the web formation process, by applying the homogenization treatment of the fiber suspension to the pulp jet discharged from the head box.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
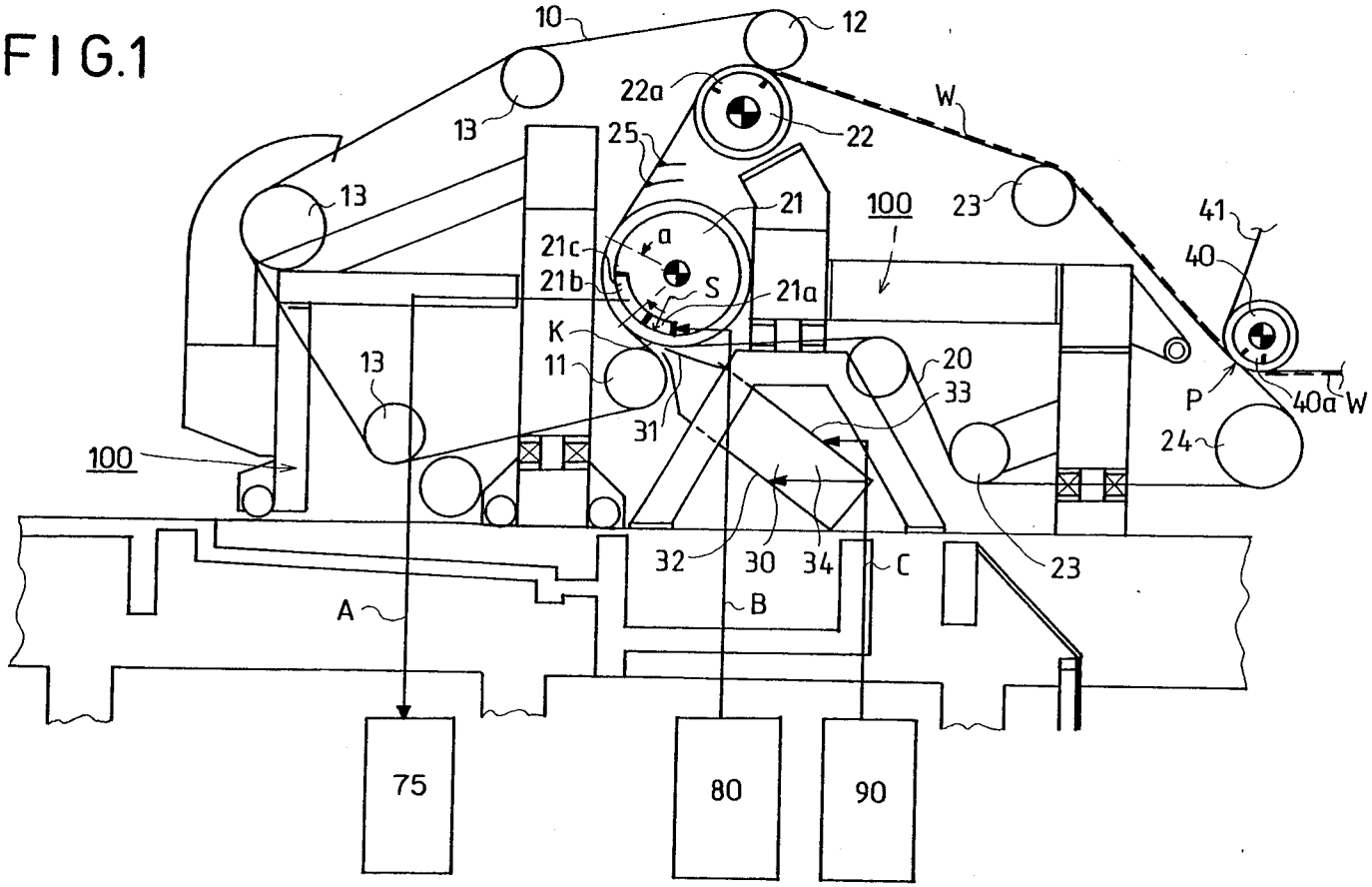
FIG. 1 is a schematic side elevation view of a web former in accordance with the invention, in which a method of the invention is applied, and in which a forming roll in accordance with the invention is utilized.
Figure 2:
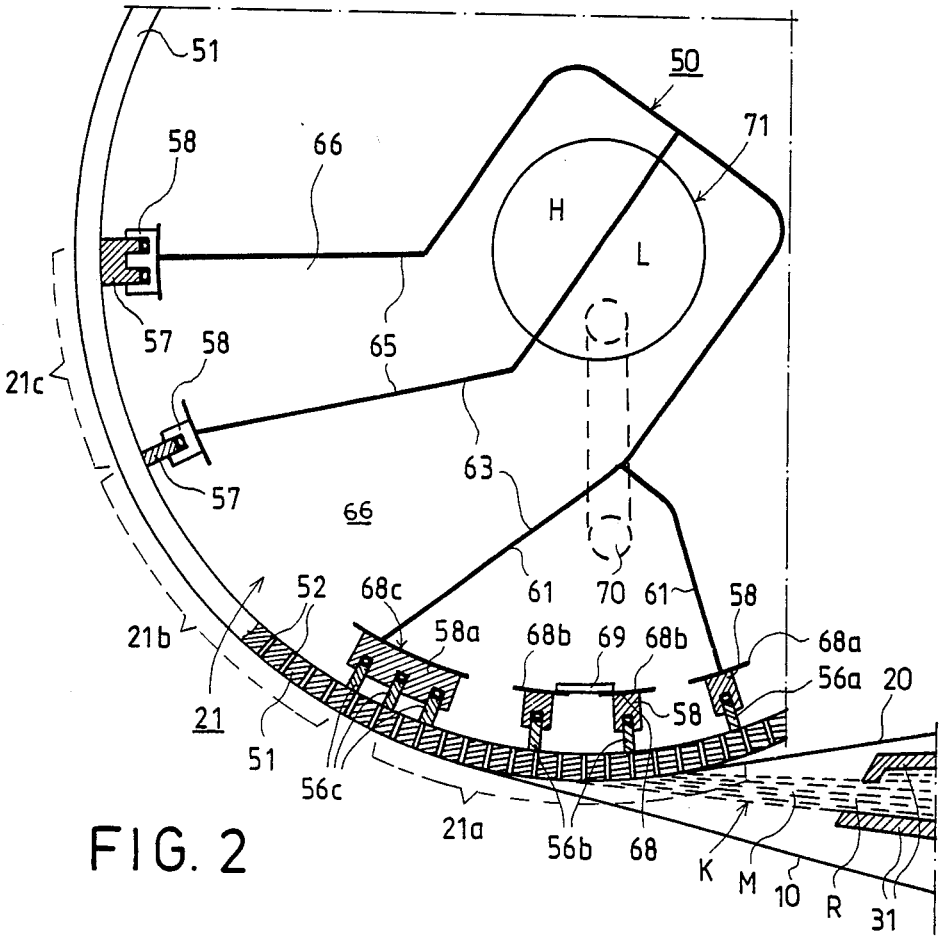
FIG. 2 is a schematic side elevation view in section of a forming roll in accordance with the invention, shown in an enlarged scale relative to FIG. 1.
Figure 2A:
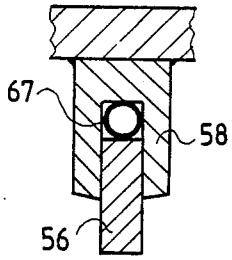
FIG. 2A illustrates a sealing arrangement for a forming roll in accordance with the invention.

Referring now to the drawings wherein like reference characters designate identical or corresponding parts throughout the several views, and more particularly to FIG. 1, a web former in accordance with the invention is illustrated applied in the configuration of a "Speed-Former" twin-wire web former of the type available from applicant's assignee, Valmet Oy of Finland. The former comprises a wire loop 10 guided by a breast roll 11 and by guide rolls 12 and 13. The wire 10 functions to cover the web that is being formed. A carrying wire loop 20 is guided by forming rolls 21 and 22 and by guide rolls 23 and 24, the wire 20 functioning to carry the web onwards after the formation process. A jet of pulp suspension is fed into the forming gap K defined by the wires 10 and 20 from the slice 31 of a head box 30. A twin wire portion of the former follows directly after the forming gap K. The twin-wire portion begins within a sector **21*a* of forming roll 21 and is guided by ceramic laths 25 or equivalent forming members, and extends up to the forming roll 22. The web W is transferred onto the carrying wire 20 within a suction zone 22*a* of forming roll 22 whereupon the web-carrying wire 20 runs along a downwardly slanting run. The web W is transferred from the carrying wire 20 onto a pick-up fabric 41 a short distance before idler roll 24 within the suction zone 40*a* of a pick-up roll 40**.

The frame of the twin-wire former is schematially illustrated in FIG. 1 and is designated 100. The forming roll 21 is situated within the loop of the carrying wire 20 and is constructed in accordance with the features of the invention to accomplish the method of the invention. The construction and operation of the forming roll 21 is described below with reference to FIGS. 2, 2A, 3 and 4.

The forming roll 21 has a mantle 51 provided with perforations or holes 52. A chamber arrangement or system 50 is installed within the mantle of forming roll 21 and includes, in accordance with the invention, a steam supply box defined by walls 61. The steam supply box communicates with a pressure sector **21*a* through which steam is supplied to act on the pulp suspension within the region of the forming gap K in accordance with the method of the invention. The steam supply box is provided with a series of axially extending seals 56*a*, 56*b* and 56*c*. The seals 56 are retained in holders 58, 58*a* and are urged positively against the inner surface of the mantle 51 by flexible pressure hoses or tubes 67, best seen in FIG. 2A. The pressure sector 21*a* begins at the first sealing lath 56*a*. Two additional or extra sealing laths 56*b* engage the inner surface of the roll mantle 51 at about the mid-region of the pressure sector 21*a*, the holders 58 of which are fastened to walls 68*b* between which an openable and closeable lath 69 is provided by means of which the supply of steam between the seals 56*b* can be adjusted or even completely eliminated. The intermediate laths 56*b* interrupt the steam supply and thereby produce an increased vibration effect in the pulp suspension layer. However, it is understood that the laths 56*b*** are not necessary to the invention and may be entirely eliminated.

The trailing edge of the steam supply or pressure sector **21*a* is defined by the engagement of sealing laths 56*c* and the inner surface of the roll mantle 51. The sealing laths 56*c* are situated one after the other and are retained by a common holder 58*a* which is attached to the wall 68*c*. By means of the successively positioned laths 56*c*, it is possible to adjust the width of the steam supply sector 21*a*. This is accomplished by pressurizing and/or depressurizing the first and/or second one of the sealing laths 56*c* in the direction of rotation of the roll so that the first and/or second sealing lath 56*c* becomes inoperative and the steam supply sector is thereby widened beyond these sealing laths 56*c*. The loading hose 67 of the last lath 56*c*** must always be maintained in its pressurized state.

Steam under pressure is fed into the steam supply chamber 61 through a pipe 70 which may pass through the suction pipe 71 and which communicates with the negative-pressure chamber 63. In this manner, no separate steam connectors are required.

As noted above, by means of the laths **56*c* or corresponding control devices, the width of the steam supply sector 21*a* can be adjusted such, for example, over a range of between about 15° to 30°, in order to regulate the desired effects. Of course, it is also possible to provide a fixed dimension steam supply sector 21*a***.

A pair of suction sectors **21*b* and 21*c* follow the steam supply sector 21*a* in the direction of forming roll 21. Suction sector 21*b* is defined between the sealing laths 56*c* and by a first axial sealing lath 57 while the second suction sector 21*c* is defined between both sealing laths 57. The sealing laths 57 are retained by holders 58. Each of the suction sectors 21*b* and 21*c* communicate with a respective suction chamber 66 defined by walls 63 and 65 respectively. The suction chambers 66 communicate with a suction system 75 (FIG. 1) through the hollow end shaft of the roll by means of suction ducts 71 (H and L). As the web-forming pulp passes over suction sectors 21***b* and 21*c* between wires 10 and 20, dewatering takes place, partly under the suction effect through the carrying wire 20. The dewatering also takes place at the suction zones 21*b* and 21*c* through the covering wire 10 under the effect of the tensioning pressure between the wires 10 and 20 and by the effect of centrifugal force.

In accordance with the method of the invention, steam (preferably waste steam produced at the paper mill) is fed to the steam supply sector 21*a* of the forming roll 21. The first sealing lath 56*a* of the steam supply sector 21*a* is preferably placed slightly before the point at which the pulp jet M from the head box 30 meets the carrying wire 20 running over the forming roll 21. The leading end of the steam supply sector 21*a* is located as such so that the steam can force the air out of the perforations 52 in the mantle 51 of roll 21 before the perforations encounter the pulp. If this is not done, the efficiency of the steam feed into the pulp suspension is reduced. The steam supply sector 21*a* of the forming roll 21 and the feeding of steam which takes place within this sector are confined to only the area where the pulp layer is still substantially uncouched. Thus, there will be no unnecessary decomposition of the formed web by means of the steam feed.

Ceramic laths 25 are positioned against the carrying wire 20 within the twin-wire zone between rolls 21 and 22. The laths cause pressure pulsations and operate in a manner similar to conventional foil laths.

The steam feed is conducted and has the result as follows. When the steam is fed through the perforations 52 in the roll mantle 51 within the steam supply sector 21 and meets the fiber suspension layer present in the forming gap K, it condenses suddenly to produce a so-called implosion, i.e. bubbles of steam which are present among the fibers of the pulp collapse. The collapsing of the bubbles, i.e., the implosion, produces high frequency mechanical vibrations in the surrounding region of the pulp, the range of the energy of the vibration being largely within the frequency range of between about 10 to 20 kHz, i.e. in the upper part of the sound frequency range and partly within the ultrasonic range.

As the bubbles of steam in the pulp suspension collapse, power is directed at the fiber layer being formed. The power has a value $P=\dot{m}(v''-v')\Delta p=\dot{m}v''\Delta p$, wherein $\dot{m}$=mass flow of steam supplied, $v''$=specific volume of steam, and $\Delta p$=difference in pressure. In a typical example, if $\dot{m}=1$ kg/s, $v''=1.5$ m$^3$/kg, and $\Delta p=10^5$N/m$^2$, P=150 kW.

The method of the invention as described above may be the fiber suspension in the head box 30 of the paper machine. Referring to FIG. 1, ultrasonic power from an ultrasonic source 90 is fed through a duct C by means of conventional ultrasonic detectors into the equalization chamber 34 of the head box 30. The ultrasonic power is substantially completely transferred into the pulp suspension flowing through the equalization chamber 34 and homogenizes the pulp suspension so that the resulting homogeneous pulp suspension jet is discharged out of the slice 31 of the head box 30 into the forming gap K between wires 10 and 20. The total ultrasonic output fed into the equalization chamber 34 of head box 30 may be on the order of about 200 kW.

Still referring to the embodiment of FIG. 1, the steam supply arrangement is shown schematically by the block 80 and the duct through which the steam is fed to the steam supply sector 21*a* of forming roll 21 is designated B. Waste steam is usually produced in a paper machine, for example in connection with the production of thermomechanical pulp (TMP), and this waste steam can be advantagesoulsy utilized as the steam supply in the present invention in order to achieve the substantial improvement in web formation and reduction in the flocculation of the web.

Figure 3:
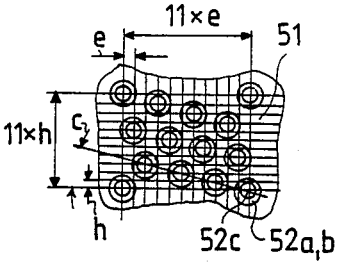
FIG. 3 is a view of a development of a region of the perforated roll mantle of the forming roll illustrating the pattern of perforations therein in accordance with the invention.
Figure 4:
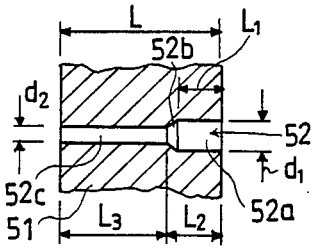
FIG. 4 is a section view of a perforation in the mantle of a forming roll in accordance with the invention.

Preferred examples of the patterning of the perforations 52 of the mantle 51 of a forming roll 21 in accordance with the invention is illustrated in FIG. 3 and a preferred example of the shape of the perforations 52 is illustrated in FIG. 4. Referring to FIG. 3, the central longitudinal axis of the perforations are situated in a grid in which the dimension of a square in the axial direction of the roll is designated h and in the direction of the circumference of the roll e. The perforations 52 are situated along diagonal "lines" relative to the axial direction of the roll, the lines forming an angle c with the circumferential direction of the roll.

According to the embodiment of FIG. 3, tan $(c)=h/3e$. The perforation pattern is a repeating pattern so that in the axial direction, the spacing of a pair of perforations located in the same axial plane is $11\times h$ and, similarly, the spacing between a pair of perforations 52 situated in the same radial plane is $11\times e$.

Referring to FIG. 4, each perforation 52 has a mouth portion 52*a* which opens at the outer face of the mantle 51 and has a diameter designated $d_1$. The mouth portion 52*a* communicates with a perforation portion 52*c* having a smaller diameter $d_2$ through a chamfered portion 52*b*. The thickness of the roll mantle 51 is designated L, the length of the mouth portion 52*b* is designated $L_2$, and the length of the smaller diameter portion 52*c* is designated $L_3$. If the diameter of the forming roll 21 is designated D, a non-restricting preferred example of the dimensions of the forming roll is as follows (all dimensions in mm):

| | |
|---|---|
| D = 1400 | $d_1$ = 9 |
| L = 45 | $d_2$ = 5 |
| $L_1$ = 12 | e = 3.5 |
| $L_2$ = 14 | h = 2.5 |

In accordance with the invention, high frequency mechanical vibrations are applied to the pulp web being formed while the web is still in substantially uncouched form. The energy range of the vibrations on a frequency scale is determined by several different factors. One of the factors is the speed v of the paper machine which, at present, may be as high as 25 m/s. Another factor is the pressure of the supply steam fed into the pulp suspension. Still another factor is the volume and shape of the perforations 52 in the roll mantle 51. The perforations 52 form a sort of acoustic system of wave tubes or pipes. Thus, the smaller the perforations 52, the smaller is their volume and, therefore, the higher is their resonance frequency. The dimensioning of the perforations 52 thereby determines the basic harmonic location of one or several energy ranges. The perforations 52 in the mantle 51 of forming roll 21 also act as a so-called acoustic siren so that the sealing laths 55 of the steam supply sector 21*a*, or the several subsequent laths, interrupt the steam supply abruptly. The frequency of this interruption depends on the speed of the basic machine. In accordance with this arrangement, one of the basic harmonic frequencies of the perforations 52 is $f_0 = v/h$, where v is the speed of the paper machine and h is the spacing between adjoining holes 52 in the radial plane, illustrated in FIG. 3.

It is seen from the foregoing that by suitably patterning the perforations of the roll mantle 51, it is possible to "tune" the acoustics of the steam supply so that the energy spectrum or range in the frequency scale is suitably selected and distributed in view of the desired effects. By means of such "tuning", most of the energy range of the acoustic output can also be selected so as to be located within the ultrasonic range so that excessive audio noise is not produced.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for forming a paper web in a twin-wire former of a paper machine comprising a carrying wire loop, a covering wire loop defining with the carrying wire loop a twin-wire forming zone and a forming gap at the beginning of said twin-wire forming zone into which a pulp suspension jet is fed from the slice of a head box, the method improving web formation and its flocculation and comprising the steps of:

running one of said carrying and covering wires over a forming roll provided with a perforated mantle within the region of said forming gap, said forming roll including a steam supply chamber within said roll mantle which communicates with a steam supply sector of said roll mantle, said steam supply sector having a leading edge which is situated slightly ahead of a region at which pulp suspension stock discharged from the headbox meets the wire running over said forming roll;

discharging pulp suspension from said head box slice into a region of the wire running over said forming roll and into said forming gap;

feeding steam under pressure into said steam supply chamber within said roll mantle and through said steam supply sector of said roll mantle into the pulp suspension when the suspension enters into the forming gap and when the web starts being formed and while the web remains substantially uncouched; and said steam feeding step being arranged so that the steam condenses in the pulp suspension to generate implosion therein which produces high frequency mechanical vibrations in said suspension having an output acting on said pulp suspension which is controllable to achieve desired effects and so that the steam blows air out of the perforations of said perforated mantle ahead of the region at which the pulp suspension stock meets the wire running over the forming roll.

2. The method of claim 1 wherein said steam supply is arranged so that the frequency of said mechanical vibrations produced by it is in the ultrasonic range.

3. The method of claim 2 wherein said steam supply is arranged so that the frequency of said mechanical vibrations provided by it is in the range of between about 10 to 20 kHz.

4. The method of claim 1 wherein said output acting on said pulp suspension due to said implosion generated by condensation of the steam fed into the pulp suspension is in the range of between about 5 to 50 kW per meter of width of the web being formed.

5. The method of claim 1 wherein said steam which is fed into the pulp suspension comprises waste steam produced at a paper mill.

6. The method of claim 3 including the additional step of controlling the range of frequency of the vibrations produced in said suspension at least in part by means of patterning the perforations in said roll mantle of said forming roll.

7. The method of claim 1 wherein prior to discharging the pulp suspension from said head box into said forming gap, applying ultrasonic power to said pulp suspension in said head box to homogenize the pulp suspension and produce microturbulence therein, at least part of said microturbulence still being effective in said pulp suspension jet discharged into said forming gap.

8. In a twin-wire former of a paper machine comprising a carrying wire loop and a covering wire loop, said loops being guided by forming rolls and guide rolls, said carrying and covering wires forming a twin-wire forming zone and a forming gap at the beginning of said twin-wire forming zone into which a pulp suspension jet is fed from the slice of a head box, the improvement comprising:

said forming gap is defined by a forming roll provided with a perforated mantle over which one of said carrying and covering wires runs within the region of said forming gap, said forming roll including a steam supply chamber within said roll mantle which communicates with a steam supply sector of said roll mantle, said steam supply sector having a leading edge which is situated slightly ahead of a region at which pulp suspension stock discharged from the head box meets the wire running over said forming roll, and a source of steam and means for supplying said steam to said steam supply chamber, said steam supply sector of said said roll mantle communicating with the pulp suspension through the wire which runs over said mantle while the pulp suspension is substantially uncouched and wherein the steam blows air out of the perforations of said perforated mantle before the pulp suspension meets said wire.

9. The combination of claim 8 wherein said steam supply chamber includes a sealing lath extending axially within said roll mantle to define said leading edge of said steam supply sector.

10. The combination of claim 8 wherein said forming roll further includes at least one negative-pressure sector of said roll mantle following said steam supply sector in the direction of rotation of said forming roll and within the twin-wire forming zone, and a source of vacuum coupled to said at least one negative-pressure sector.

* * * * *